US011834734B2

(12) United States Patent
Wu

(10) Patent No.: US 11,834,734 B2
(45) Date of Patent: Dec. 5, 2023

(54) METHOD OF MANUFACTURING A STAINLESS STEEL FASTENER

(71) Applicant: Hsiang Wu, Tainan (TW)

(72) Inventor: Hsiang Wu, Tainan (TW)

( * ) Notice: Subject to any disclaimer, the term of this patent is extended or adjusted under 35 U.S.C. 154(b) by 0 days.

(21) Appl. No.: 17/564,582

(22) Filed: Dec. 29, 2021

(65) Prior Publication Data

US 2023/0203628 A1 Jun. 29, 2023

(51) Int. Cl.

| | |
|---|---|
| ***C22C 38/44*** | (2006.01) |
| ***C23C 22/00*** | (2006.01) |
| ***C21D 9/00*** | (2006.01) |
| ***C22C 38/00*** | (2006.01) |

(52) U.S. Cl.

CPC ..... *C22C 38/44* (2013.01); *C21D 9/0068* (2013.01); *C22C 38/001* (2013.01); *C23C 22/00* (2013.01)

(58) Field of Classification Search

CPC ..... B23G 9/001; B21K 1/46; C22C 38/001; C22C 38/38; C22C 38/58; C21D 9/0093; C21D 1/25; C21D 1/42; C21D 2221/00; C21D 6/002; C21D 6/02; C21D 1/10; C21D 1/18; C21D 1/58; C21D 1/60; C21D 1/785; C21D 2211/002; C21D 2221/01; C21D 2221/10; C21D 6/004; C21D 8/06; C21D 9/08; C21D 9/28

USPC ..... 420/38

See application file for complete search history.

(56) References Cited

U.S. PATENT DOCUMENTS 6,338,600 B2 * 1/2002 Friederich ..... C21D 6/02 411/386

6,679,954 B1 * 1/2004 Takano ..... C22C 38/54 148/325

FOREIGN PATENT DOCUMENTS

JP 63045320 A * 2/1988

OTHER PUBLICATIONS

NPL: on-line translation of JP-63045320-A, Feb. 1988 (Year: 1988).*

* cited by examiner

*Primary Examiner* — Jie Yang

(74) *Attorney, Agent, or Firm* — Rosenberg, Klein & Lee

(57) ABSTRACT

A method of manufacturing a stainless steel fastener includes following operations. Firstly, a stainless steel blank is prepared and contains from 1 to 3.5 wt % molybdenum, from 10 to 16 wt % chromium, from 0.5 to 3.5 wt % nickel, from 0.05 to 0.3 wt % nitrogen, carbon which is not more than 0.2 wt %, iron, and other inevitable compositions. Initially, a steel crystalline structure of the blank is martensite whose hardness ranges from 230 to 350 HV. Then, the blank is annealed to transform a partial crystalline structure of the steel crystalline structure into ferrite. The annealed blank experiences a cutting operation, a head forming operation, and a thread forming operation sequentially. Thereafter, a heat treating operation is executed to transform the partial crystalline structure from ferrite into martensite to complete a stainless steel fastener whose hardness is increased and is at least 500 HV, which facilitates a direct drilling effect.

4 Claims, 2 Drawing Sheets

METHOD OF MANUFACTURING A STAINLESS STEEL FASTENER

BACKGROUND OF THIS INVENTION

1. Field of this Invention

This invention relates to a method and relates particularly to a method of manufacturing a stainless steel fastener capable of facilitating a direct drilling effect.

2. Description of the Related Art

Fasteners are commonly used in the assembly of various machinery, construction, and transportation. Fasteners with high strength are usually made of metal and formed to have a cylindrical shape or other specific shapes. A surface of each fastener is provided with a plurality of threads to thereby achieve a tight engagement between an object and the fastener. General fasteners are mainly made of carbon steel. Carbon steel is easy to be processed and can help increase a hardness value of the fastener to thereby facilitate a drilling operation of the fastener. However, the fastener will be exposed to open air for a long time after screwing into an object. The fastener will also bear the sun, the rain and the wind if it is screwed into a roof, and that will easily rust and damage the fastener because the carbon steel is not provided with corrosion resistance properties. Although the fastener can be provided with corrosion resistance properties when it is made of stainless steel, the hardness value of the fastener will be small. Thus, the fastener made of stainless steel cannot be adapted to screw into an object which is not provided with a pre-drilled hole. Hence, the use of the fastener made of stainless steel is restricted.

In order to equip the fastener with corrosion resistance properties and greater hardness value simultaneously, a bi-compositional fastener is disclosed. The bi-compositional fastener has a head made of stainless steel and a drilling portion made of carbon steel. The head and the drilling portion that are made of different steel materials are welded together to form the bi-compositional fastener. Thus, the drilling portion made of carbon steel is provided with larger hardness value and greater strength, and that facilitates a direct drilling effect and allows the drilling portion to drill into an object directly and quickly. The head made of stainless steel is rust-proof to thereby prevent the head from rusting easily after the bi-compositional fastener is positioned in the object and exposed to open air.

However, the bi-compositional fastener still has deficiencies as below.

1. The manufacturing costs are high. Because the head and the drilling portion of the bi-compositional fastener are made of different steel materials, the head and the drilling portion should be prepared separately. After the head and the drilling portion are prepared, the head and the drilling portion are welded and integrated to form a bi-compositional blank. The bi-compositional blank is then processed by operations of skiving, threading, ultrasonic cleaning, vacuuming, and surface treating in order to reach qualified strength and hardness value and provide corrosion resistance properties. Thus, the processing complexity and costs will increase greatly.

2. The bi-compositional fastener still rusts easily. The surface treating operation such as galvanizing treatment, Ruspert treatment and so on is executed to form an electroplating layer on a surface of the bi-compositional fastener in order to prevent the bi-compositional fastener from rusting easily. However, the electroplating layer formed on the drilling portion of the bi-compositional fastener will be stripped off easily during a drilling operation, and that will reduce a corrosion resistance effect. The drilling portion of the bi-compositional fastener will rust easily, and that will weaken the engagement between the bi-compositional fastener and the object. Thus, the bi-compositional fastener cannot be fixed in the object effectively.

3. The strength of the integration of the head and the drilling portion is weak. Because the head and the drilling portion of the bi-compositional fastener are integrated by welding, the tensile strength is poor. Thus, the head and the drilling portion may separate easily during the drilling operation.

Hence, above deficiencies require to be improved.

SUMMARY OF THIS INVENTION

The object of this invention is to provide a method of manufacturing a stainless steel fastener providing with high strength and corrosion resistance properties to thereby facilitate a direct drilling effect.

The method of this invention includes a preparing operation, an annealing operation, a cutting operation, a head forming operation, a thread forming operation, and a heat treating operation. The preparing operation prepares a stainless steel blank having an overall composition. The overall composition contains a molybdenum content ranging from 1 wt % to 3.5 wt %, a chromium content ranging from 10 wt % to 16 wt %, a nickel content ranging from 0.5 wt % to 3.5 wt %, a nitrogen content ranging from 0.05 wt % to 0.3 wt %, and a carbon content which is not more than 0.2 wt %, an iron content. The remainder of the overall composition is iron and inevitable compositions inherent in the stainless steel blank. A steel crystalline structure of the stainless steel blank is initially defined as martensite and has a hardness value ranging from 230 HV to 350 HV. The annealing operation subjects the stainless steel blank to an annealing treatment to thereby transform a partial crystalline structure of the steel crystalline structure of the stainless steel blank into ferrite, and reduce the hardness value of the stainless steel blank to be not more than 200 HV. The cutting operation cuts the stainless steel blank according to a length. The head forming operation presses one end of the stainless steel blank to thereby form a head. A remainder of the stainless steel blank is defined as a shank connected to the head after the one end is pressed. The shank has a distal end opposite to the head. The thread forming operation shapes the distal end of the shank to form a drilling portion and forms a threaded portion on the shank. The threaded portion is formed between the head and the drilling portion. The heat treating operation prepares a heat treatment device and subjects the stainless steel blank to a heat treatment with the heat treatment device to thereby transform the partial crystalline structure of the stainless steel blank from ferrite into martensite during the heat treatment and complete a stainless steel fastener. A hardness value of the stainless steel fastener is increased to be at least 500 HV when a nitriding effect derived from the nitrogen content and the carbon content is caused during the heat treatment. The molybdenum content, the chromium content, and the nickel content provide the stainless steel fastener with corrosion resistance properties. Thus, the stainless steel fastener is provided with great hardness value and high strength to thereby facilitate a direct drilling effect. The manufacturing costs and processing complexity are also reduced.

Preferably, the heat treatment device is a vacuum stove.

Preferably, a passivation operation is executed after the heat treating operation. The passivation operation includes immersing the stainless steel fastener in a passivation solution to thereby form a passivation film on a surface of the stainless steel fastener.

DETAILED DESCRIPTION OF THE PREFERRED EMBODIMENTS

Figure 1:
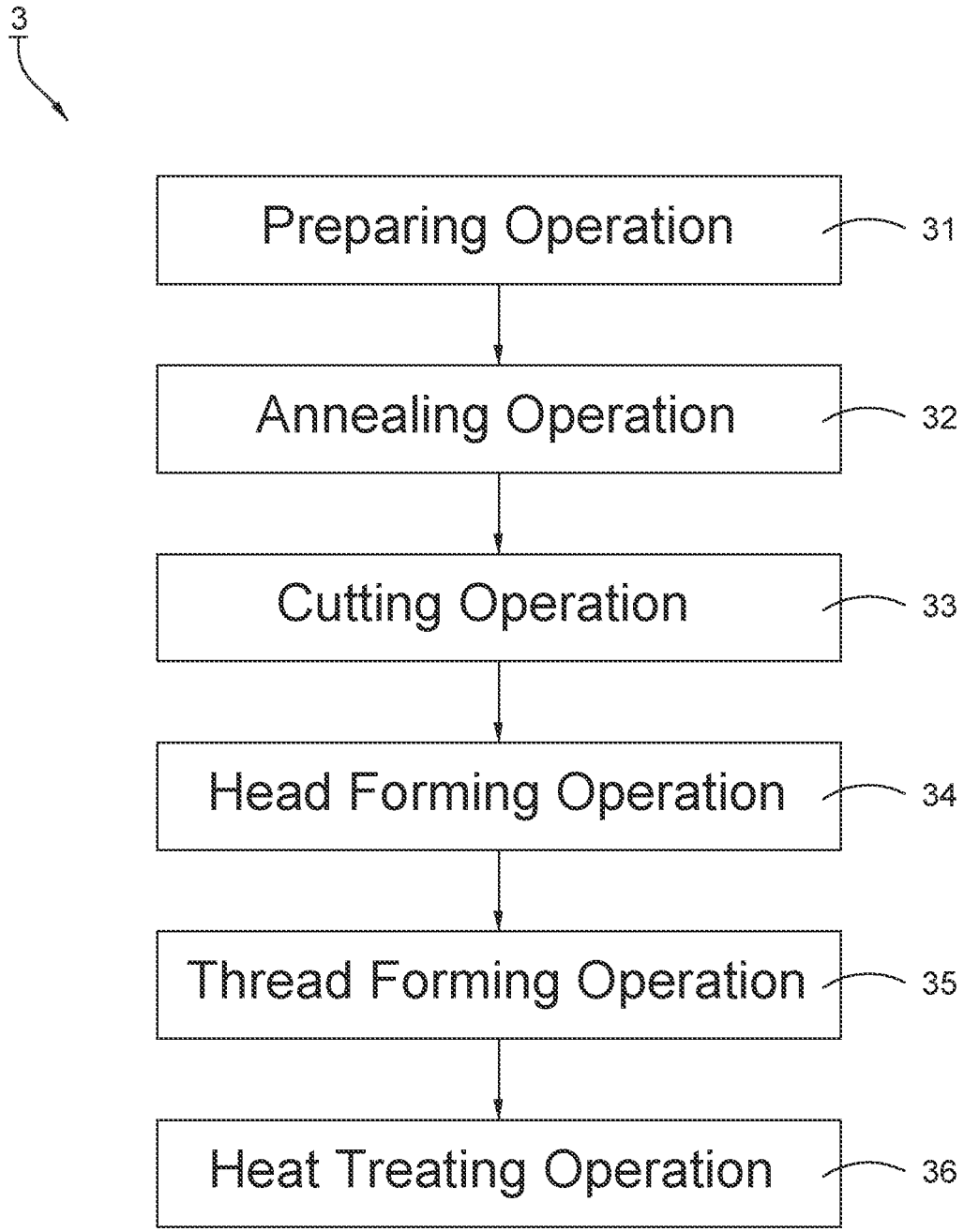
FIG. 1 is a block diagram showing the operations of a first preferred embodiment of this invention in sequential order.

Referring to FIG. 1, a method 3 of manufacturing a stainless steel fastener of a first preferred embodiment of this invention includes a preparing operation 31, an annealing operation 32, a cutting operation 33, ahead forming operation 34, a thread forming operation 35, and a heat treating operation 36. The preparing operation 31 prepares a stainless steel blank. The stainless steel blank has an overall composition. The overall composition contains a molybdenum content ranging from 1 wt % to 3.5 wt %, a chromium content ranging from 10 wt % to 16 wt %, a nickel content ranging from 0.5 wt % to 3.5 wt %, a nitrogen content ranging from 0.05 wt % to 0.3 wt %, and a carbon content which is not more than 0.2 wt %. The remainder of the overall composition of the stainless steel blank is iron and other inevitable or unavoidable compositions inherent in the manufacturing of the stainless steel blank. Besides, a steel crystalline structure of the stainless steel blank is initially defined as martensite, and particularly the structure of the stainless steel blank has a hardness value ranging from 230 HV to 350 HV. Regarding the iron, the iron content can be above 70 wt %, namely be equal to 70 wt % or more than 70 wt %. The inevitable compositions mean requisite constituents required in constituting the stainless steel blank when the blank is manufactured. It is possible that the inevitable compositions contain silicon, manganese, phosphorus, sulfur, and other impurities. Examples of a total content (100 wt %) of the overall composition are given as below.

| Example | Molybdenum (wt %) | Chromium (wt %) | Nickel (wt %) | Nitrogen (wt %) | Carbon (wt %) | Iron (wt %) | Inevitable compositions (wt %) |
|---|---|---|---|---|---|---|---|
| 1 | 1 | 11 | 0.8 | 0.05 | 0.08 | 73 | 14.07 |
| 2 | 2 | 12.5 | 1 | 0.015 | 0.12 | 71 | 13.365 |
| 3 | 2.5 | 14 | 2.5 | 0.015 | 0.1 | 72 | 8.885 |
| 4 | 3.5 | 14 | 2.5 | 0.015 | 0.1 | 73 | 6.885 |
| 5 | 1.5 | 12 | 1.2 | 0.2 | 0.2 | 76 | 8.9 |

The annealing operation 32 subjects the stainless steel blank to an annealing treatment whereby a partial crystalline structure of the steel crystalline structure of the stainless steel blank is transformed into ferrite. The hardness value of the stainless steel blank is reduced to a value which is not more than 200 HV to thereby facilitate following operations.

The cutting operation 33 cuts the stainless steel blank according to a length. The head forming operation 34 presses one end of the stainless steel blank treated by the cutting operation 33 to thereby form a head. A remainder of the stainless steel blank is defined as a shank connected to the head after the one end is pressed. The shank has a distal end opposite to the head. The thread forming operation 35 shapes the distal end of the shank to form a drilling portion and also forms a threaded portion on the shank. The threaded portion is formed between the head and the drilling portion.

The heat treating operation 36 prepares a heat treatment device and subjects the stainless steel blank treated by the thread forming operation 35 to a heat treatment with the heat treatment device. The partial crystalline structure of the stainless steel blank is transformed from ferrite into martensite during the heat treatment to thereby complete a stainless steel fastener. A hardness value of the stainless steel fastener is increased when a nitriding effect derived from the nitrogen content and the carbon content is caused during the heat treatment. The hardness value of the stainless steel fastener is increased to be at least 500 HV, and that facilitates a direct drilling effect. Further, the molybdenum content, the chromium content, and the nickel content provide the stainless steel fastener with corrosion resistance properties. Hence, the stainless steel fastener can be adapted to drill into an object which is not provided with a pre-drilled hole directly. Because there is no need to pierce a hole on the object in advance, the drilling operation is simplified. Hence, the stainless steel fastener is provided with great hardness value, great strength, and corrosion resistance properties. The manufacturing costs and processing complexity are also reduced.

Figure 2:
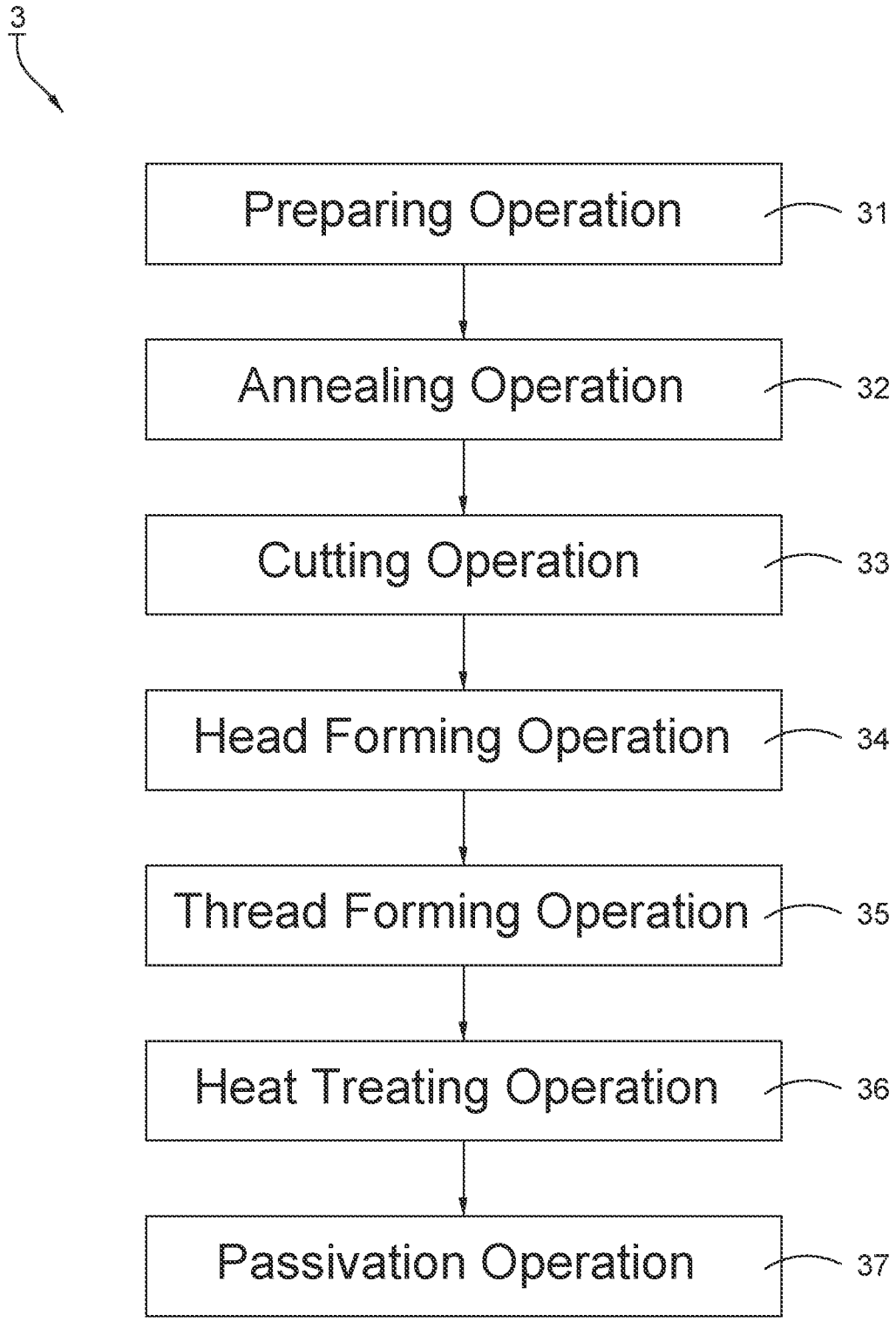
FIG. 2 is a block diagram showing the operations of a second preferred embodiment of this invention in sequential order.

Referring to FIG. 2 shows a second preferred embodiment of the method 3 of this invention. The second preferred embodiment still includes the preparing operation 31, the annealing operation 32, the cutting operation 33, the head forming operation 34, the thread forming operation 35, and the heat treating operation 36 of the first preferred embodiment. This embodiment is characterized in that a passivation operation 37 is executed after the heat treating operation 36. The passivation operation 37 includes immersing the stainless steel fastener in a passivation solution to thereby form a passivation film on a surface of the stainless steel fastener. Thus, the passivation film can cover pores formed on the surface of the stainless steel fastener to thereby prevent the stainless steel fastener from rusting easily, enhance the corrosion resistance properties of the stainless steel fastener, and prolong the service life of the stainless steel fastener.

To sum up, the method of this invention includes the preparing operation, the annealing operation, the cutting operation, the head forming operation, the thread forming operation, and the heat treating operation. The preparing operation prepares a stainless steel blank containing a molybdenum content, a chromium content, a nickel content, a nitrogen content, a carbon content, an iron content, and an inevitable content. A steel crystalline structure of the stainless steel blank is initially defined as martensite and having a hardness value ranging from 230 HV to 350 HV. The annealing operation executes an annealing treatment of the stainless steel blank whereby a partial crystalline structure of the steel crystalline structure of the stainless steel blank is transformed into ferrite. The hardness value of the stainless steel blank is reduced to a value which is not more than 200 HV. The cutting operation cuts the stainless steel blank according to a length. The head forming operation and the thread forming operation process the stainless steel blank to have a head, a shank extending outwards from the head, a drilling portion connected to the shank and opposite to the head, and a threaded portion formed on shank and located between the head and the drilling portion. The heat treating operation executes a heat treatment of the stainless steel blank through a heat treatment device to thereby transform the partial steel crystalline structure of the stainless steel blank from ferrite into martensite during the heat treatment to thereby complete a stainless steel fastener. A hardness value of the stainless steel fastener is increased when a nitriding effect derived from the nitrogen content and the carbon content is caused during the heat treatment. The hardness value of the stainless steel fastener is increased to be at least 500 HV. The molybdenum content, the chromium content, and the nickel content equip the stainless steel fastener with corrosion resistance properties. Thus, the stainless steel fastener is provided with large strength, large hardness value, and corrosion resistance properties to thereby facilitate a direct drilling effect.

While the embodiments of this invention are shown and described, it is understood that further variations and modifications may be made without departing from the scope of this invention.

What is claimed is:

1. A method of manufacturing a stainless steel fastener, comprising in sequence:

a preparing operation including preparing a stainless steel blank, said stainless steel blank having an overall composition containing a molybdenum content ranging from 1 wt % to 3.5 wt %, a chromium content ranging from 10 wt % to 16 wt %, a nickel content ranging from 0.5 wt % to 3.5 wt %, a nitrogen content ranging from 0.05 wt % to 0.3 wt %, and a carbon content which is not more than 0.2 wt %, and a remainder of said overall composition being iron and inevitable compositions inherent in said stainless steel blank, and a steel crystalline structure of said stainless steel blank being initially defined as martensite and having a hardness value ranging from 230 HV to 350 HV;

an annealing operation including subjecting said stainless steel blank to an annealing treatment whereby a partial crystalline structure of said steel crystalline structure of said stainless steel blank is transformed from martensite into ferrite, and said hardness value of said stainless steel blank is reduced to a value which is not more than 200 HV;

a cutting operation including cutting said stainless steel blank whose hardness is not more than 200 HV according to a length;

a head forming operation including pressing one end of said stainless steel blank treated by said cutting operation to thereby form a head, a remainder of said stainless steel blank being defined as a shank connected to said head after said one end is pressed, with said shank having a distal end opposite to said head;

a thread forming operation including shaping said distal end of said shank to form a drilling portion and also includes forming a threaded portion on said shank, with said threaded portion formed between said head and said drilling portion; and a heat treating operation including preparing a heat treatment device and subjecting said stainless steel blank treated by said thread forming operation to a heat treatment with said heat treatment device, wherein said partial crystalline structure of said stainless steel blank is transformed from ferrite into martensite during said heat treatment to thereby complete a stainless steel fastener, a hardness value of said stainless steel fastener being increased when a nitriding effect derived from said nitrogen content and said carbon content is caused during said heat treatment, with said hardness value of said stainless steel fastener being at least 500 HV, said molybdenum content, said chromium content, and said nickel content providing said stainless steel fastener with corrosion resistance properties.

2. The method according to claim 1, wherein said heat treatment device is a vacuum stove.

3. The method according to claim 1, further comprising a passivation operation, said passivation operation being executed after said heat treating operation and including immersing said stainless steel fastener in a passivation solution to thereby form a passivation film on a surface of said stainless steel fastener.

4. The method according to claim 2, further comprising a passivation operation, said passivation operation being executed after said heat treating operation and including immersing said stainless steel fastener in a passivation solution to thereby form a passivation film on a surface of said stainless steel fastener.

* * * * *